US010076758B2

(12) United States Patent
Wang

(10) Patent No.: US 10,076,758 B2
(45) Date of Patent: Sep. 18, 2018

(54) NOZZLE ADJUSTMENT MEMBER

(71) Applicant: YUAN-MEI CORP., Changhua County (TW)

(72) Inventor: King-Yuan Wang, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 34 days.

(21) Appl. No.: 15/015,126

(22) Filed: Feb. 4, 2016

(65) Prior Publication Data

US 2016/0151793 A1 Jun. 2, 2016

Related U.S. Application Data

(63) Continuation-in-part of application No. 12/662,295, filed on Apr. 9, 2010, now Pat. No. 9,289,783.

(51) Int. Cl.

| | |
|---|---|
| ***B05B 3/00*** | (2006.01) |
| ***B05B 1/14*** | (2006.01) |
| ***B05B 15/652*** | (2018.01) |
| ***B05B 15/68*** | (2018.01) |

(52) U.S. Cl.

CPC ..... *B05B 1/14* (2013.01); *B05B 3/00* (2013.01); *B05B 15/652* (2018.02); *B05B 15/68* (2018.02)

(58) Field of Classification Search

CPC ..... B05B 1/14; B05B 15/08; B05B 15/066; B05B 15/04

USPC ... 239/240, 246, 247, DIG. 1, DIG. 12, 242, 239/225, 227

See application file for complete search history.

(56) References Cited

U.S. PATENT DOCUMENTS 6,135,356 A * 10/2000 Mitzlaff ..... B05B 15/066 239/1

7,427,038 B2 * 9/2008 Wang ..... B05B 15/066 239/240

* cited by examiner

*Primary Examiner* — Steven J Ganey

*Assistant Examiner* — Viet Le

(74) *Attorney, Agent, or Firm* — Raymond Y. Chan; David and Raymond Patent Firm

(57) ABSTRACT

A sprinkler adjustment member includes a plurality of nozzle tubes aligned in a sprinkler base. An adjustment piece is assembled with the sprinkler base. The adjustment piece controls and guide the plurality of nozzle tubes correspondingly and the adjustment piece swings so as to drive the plurality of nozzle tubes moving at an angle and different water distribution patterns are provided. The sprinkler base is pivotally disposed on a receiving member and for adjustment angle with a pendulum movement. A place base is connected with the receiving member and the receiving member is capable of pivoting on the place base, such that the sprinkler moves and tilts at multi-angles and multi-directions for providing various sprinkling patterns.

12 Claims, 9 Drawing Sheets

NOZZLE ADJUSTMENT MEMBER

ROSS REFERENCE OF RELATED APPLICATION

This is a Continuation-In-Part Application that claims priority to U.S. non-provisional application, application Ser. No. 12/662,295, filed Apr. 9, 2010, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a sprinkler adjustment member, and more particularly to a sprinkler placed on the ground that adjusts water distribution patterns into a plurality of water jets with increasing angles between two adjacent water flows gradually or a plurality of water jets with adjustable angles and adjustable sprinkling orientation.

Description of Related Arts

Referring to prior arts such as U.S. Pat. No. 6,135,356, US20080054103, U.S. Pat. No. 2,943,796 and U.S. Pat. No. 8,534,573, the adjustment apparatus in these patents adjusts nozzles mounted therein synchronously by a parallel displacement of the nozzle or displacement on two-sides in different directions such that the sprinkler is adjustable to provide sprinkling patterns with different umbrella-type angles of 2 dimensions changes. However, the adjustment apparatus cannot adjust orientation pivotally and is not able to adjust the upwardly and downwardly moving angles.

Thus there is a need to improve the sprinkler adjustment apparatus available now so as to provide a novel design of the sprinklers so as to provide sprinkling patterns with different angles of 3 dimensions control.

SUMMARY OF THE PRESENT INVENTION

The invention is advantageous in that it provides a sprinkler adjustment member that includes at least two pivoting arrangements, thereby the sprinkler base has an ability of angles controlling within a pendulum path and an ability of azimuth controlling to rotate pivotally within 360 degrees.

Additional advantages and features of the invention will become apparent from the description which follows, and may be realized by means of the instrumentalities and combinations particular point out in the appended claims.

In order to achieve the above object, a sprinkler adjustment member according to the present invention mainly includes a sprinkler base, an adjustment piece and a cover.

The sprinkler base is connected with a pivot disposed on a top of a base of a sprinkler. A flat top stage with a plurality of holes is arranged on top of the sprinkler base. The plurality of holes is arranged into at least one row and each hole is positioned over a corresponding nozzle tube. A top end of each nozzle tube projects from the hole and a bottom of each nozzle tube is connected in series by at least one belt. Moreover, at least one pivot support is arranged at outside of the flat top stage and is pivoted with the adjustment piece for swinging and movement of the adjustment piece.

The adjustment piece includes a pivot hole pivoted with the above pivot support arranged at one end thereof, a plurality of guiding openings spaced at an interval on the other end thereof and at least one control part on the end opposite to the end with the pivot hole. The plurality of guiding openings is positioned over the plurality of nozzle tubes. The control part is for convenience of holding and moving the adjustment piece and is integrated with the adjustment piece.

The cover is fastened and connected with the sprinkler base. A plurality of long through holes for being assembled with corresponding nozzle tubes is disposed on top of the cover.

In accordance with the structure form by above components, the pivot hole and the pivot support pivoted with each other is used as a rotation pivot and the adjustment piece can swing and move for synchronously driving the nozzle tube positioned inside each guiding opening to move at different umbrella-type angles. Due to the change of the angle of the nozzle tube driven by the corresponding guiding opening of the adjustment piece, the water distribution pattern changes into a plurality of parallel water jets or a plurality of water jets with increasing umbrella-type angles therebetween and more sprinkling patterns are provided.

The invention is advantageous in that it provides a sprinkler adjustment member that includes at two pivoting arrangements for providing various sprinkling patterns at multi-angles and multi-directions, thereby the sprinkler has an ability of angles controlling within a pendulum path and an ability of azimuth controlling.

The present invention comprises a sprinkler base, a receiving member and a place base. The sprinkler base is assembled with the receiving member and the place base is connected with the receiving member. The sprinkler base comprises a first connecting member and a second connecting member. A first pivoting member extends from the first connecting member and an axle hole is disposed on the second connecting member which opposite to the first connecting member. A pivot connecting element is disposed on one side of the receiving member and a pivot is disposed on the opposite side of the receiving member.

The first pivoting member is assembled with the pivot connecting element of the receiving member and the pivot of the receiving member is positioned over the axle hole, thereby constituting a first assembly arrangement such that the sprinkler base is capable of adjusting angles in a pendulum path on the receiving member. Moreover, a second pivoting member extends from one end of the receiving member and forms a second assembly arrangement. An assembly member assembled with and fixed in the place base, wherein the second pivoting member is positioned over the assembly member and the second pivoting member is capable of pivoting on the assembly member, thereby the receiving member rotates pivotally for 360 degrees on the place base and the sprinkler base is driven to adjust and to locate the sprinkling angles with a pendulum path rotation, such that the sprinkler moves and tilts at multi-angles and multi-directions for providing various sprinkling patterns.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
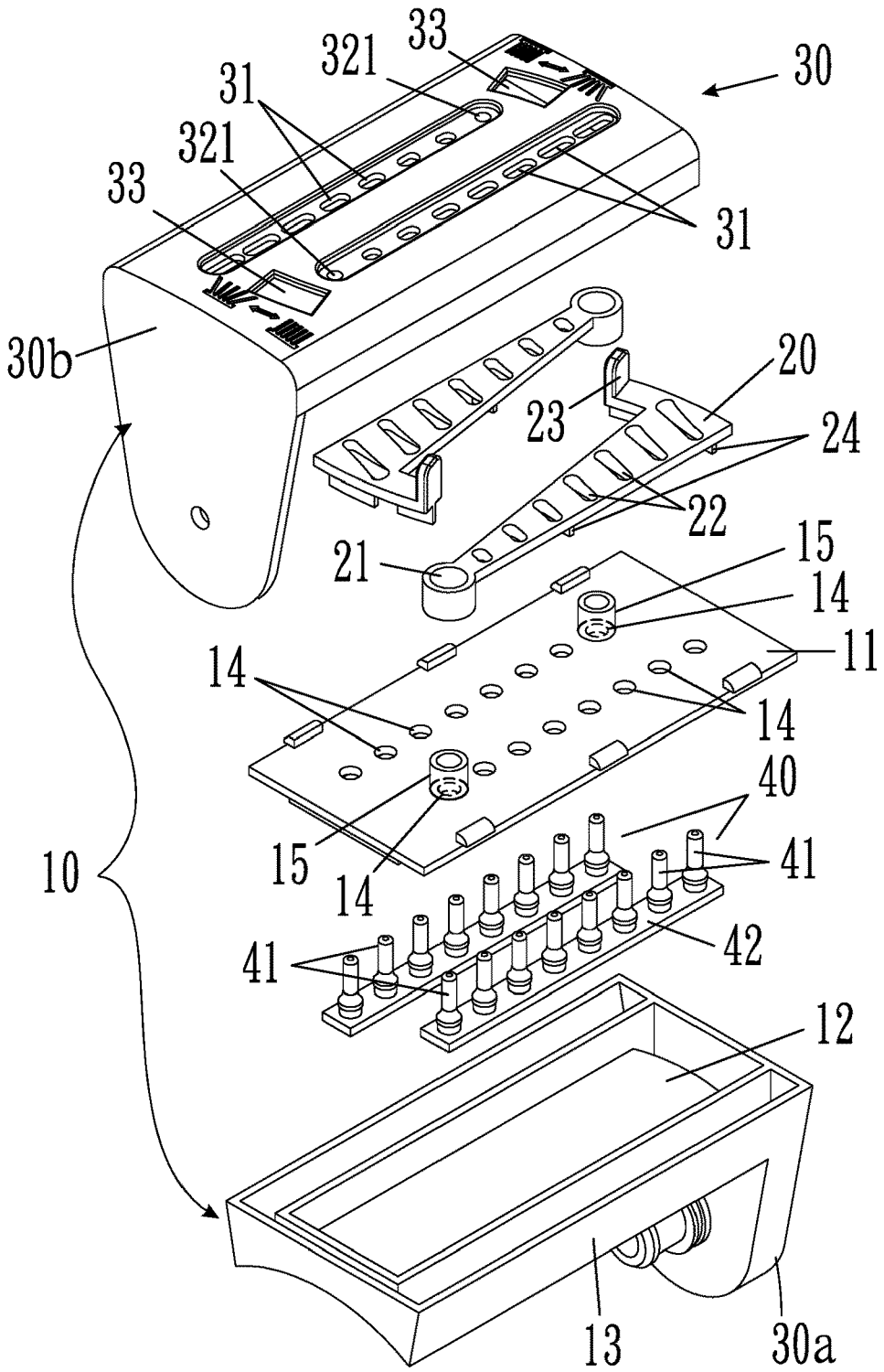
FIG. 1 is an exploded perspective view of a sprinkler base according to an embodiment of the present invention.
Figure 2:
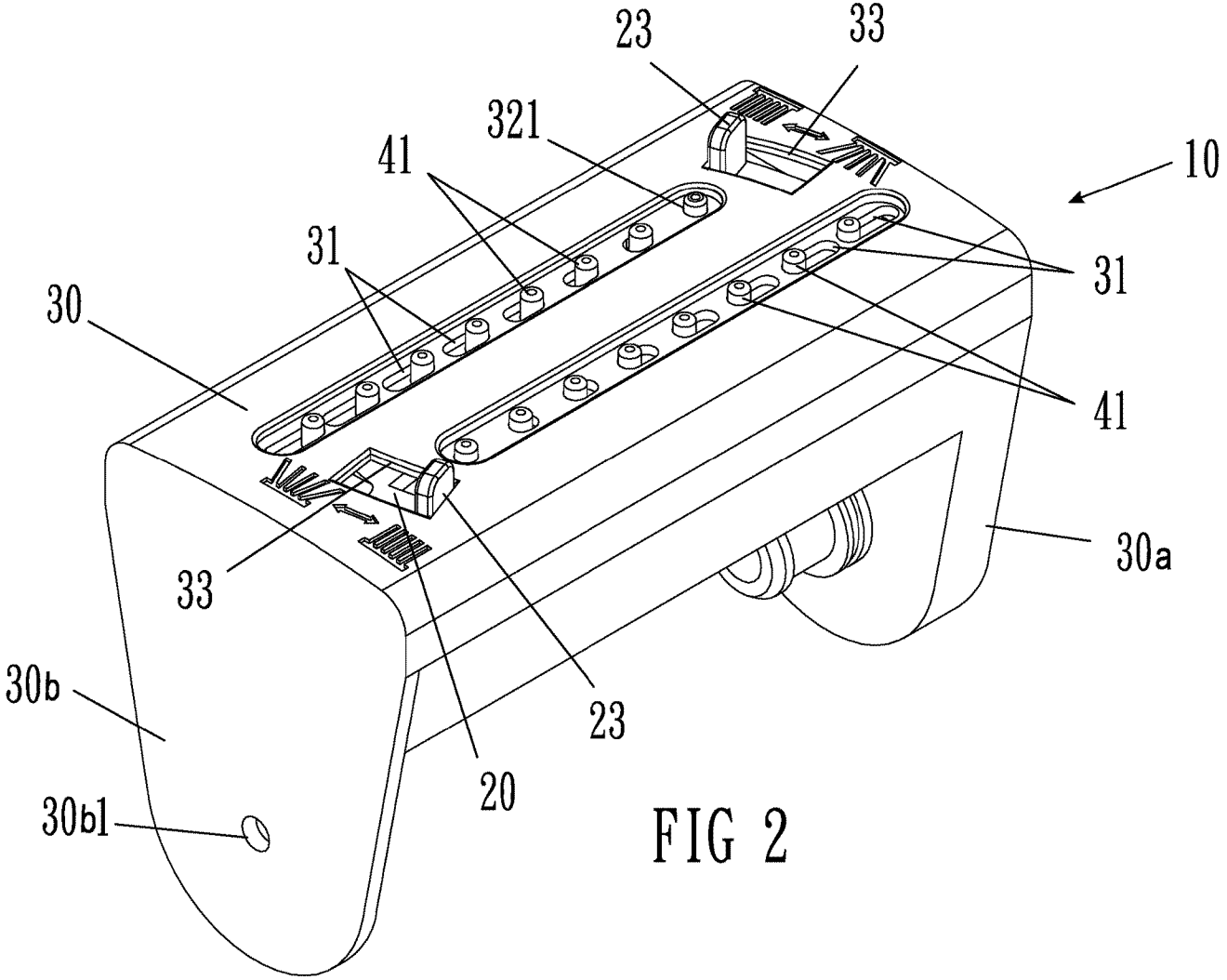
FIG. 2 is a perspective assembly view of a sprinkler base according to an embodiment of the present invention.
Figure 3:
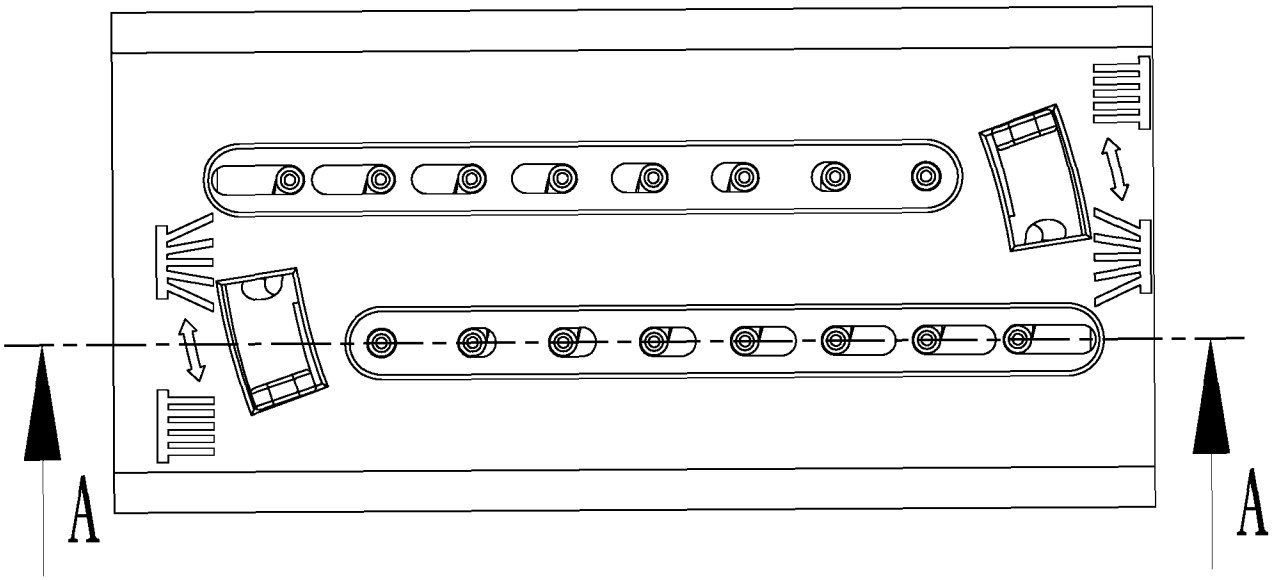
FIG. 3 is a top assembly view of a sprinkler base according to an embodiment of the present invention.
Figure 4:
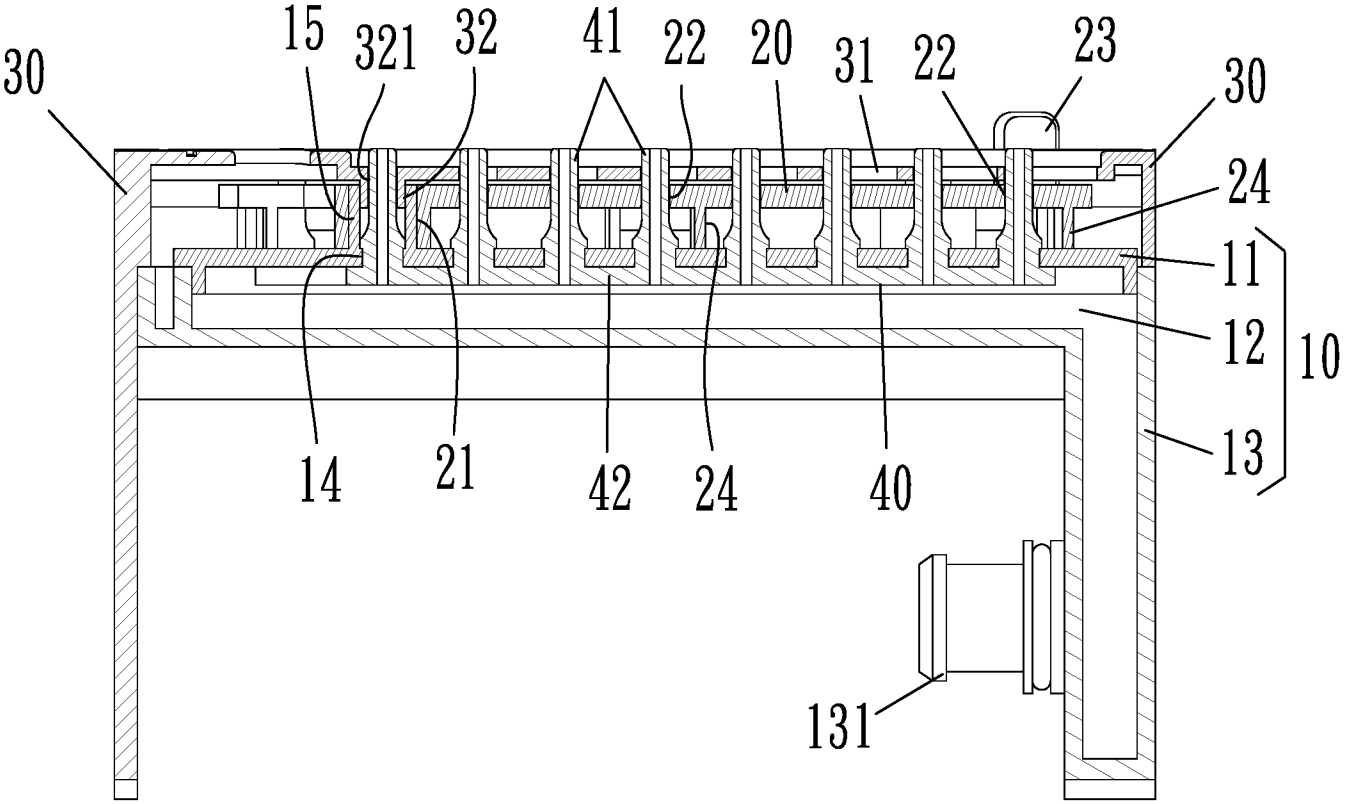
FIG. 4 is a cross sectional view along the A-A line of the embodiment in FIG. 3.
Figure 5:
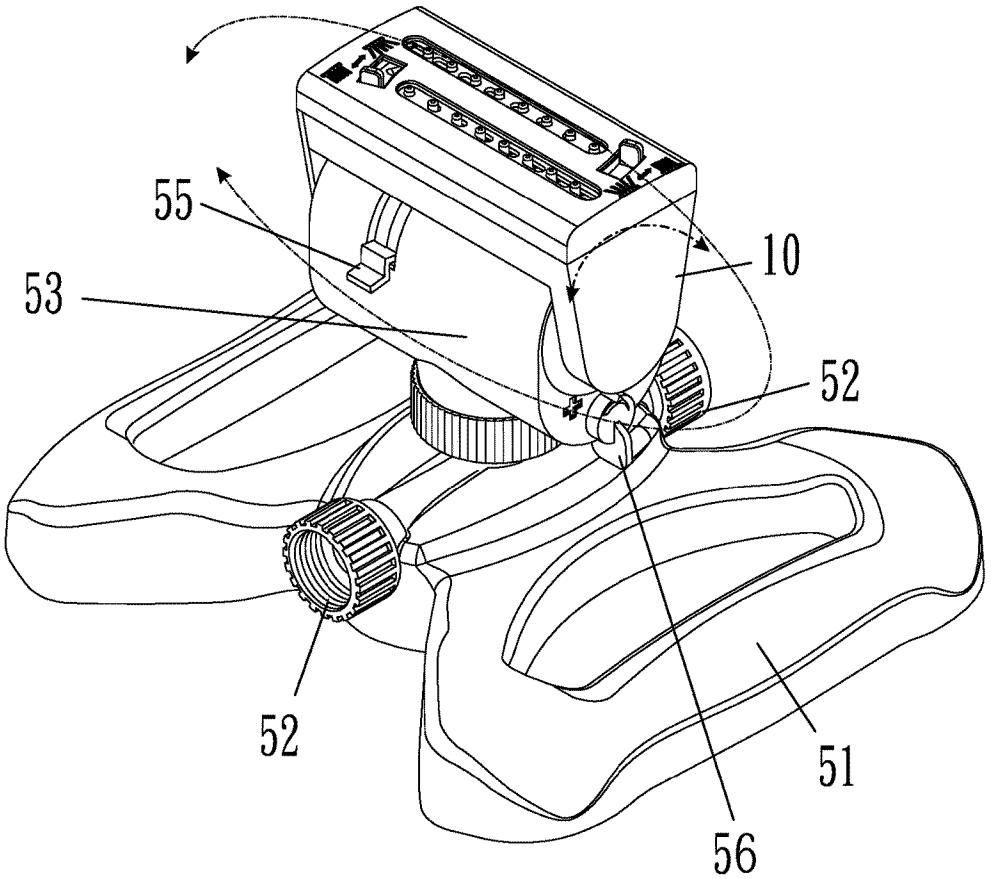
FIG. 5 is a perspective view of a sprinkler combination according to an embodiment of the present invention.
Figure 6:
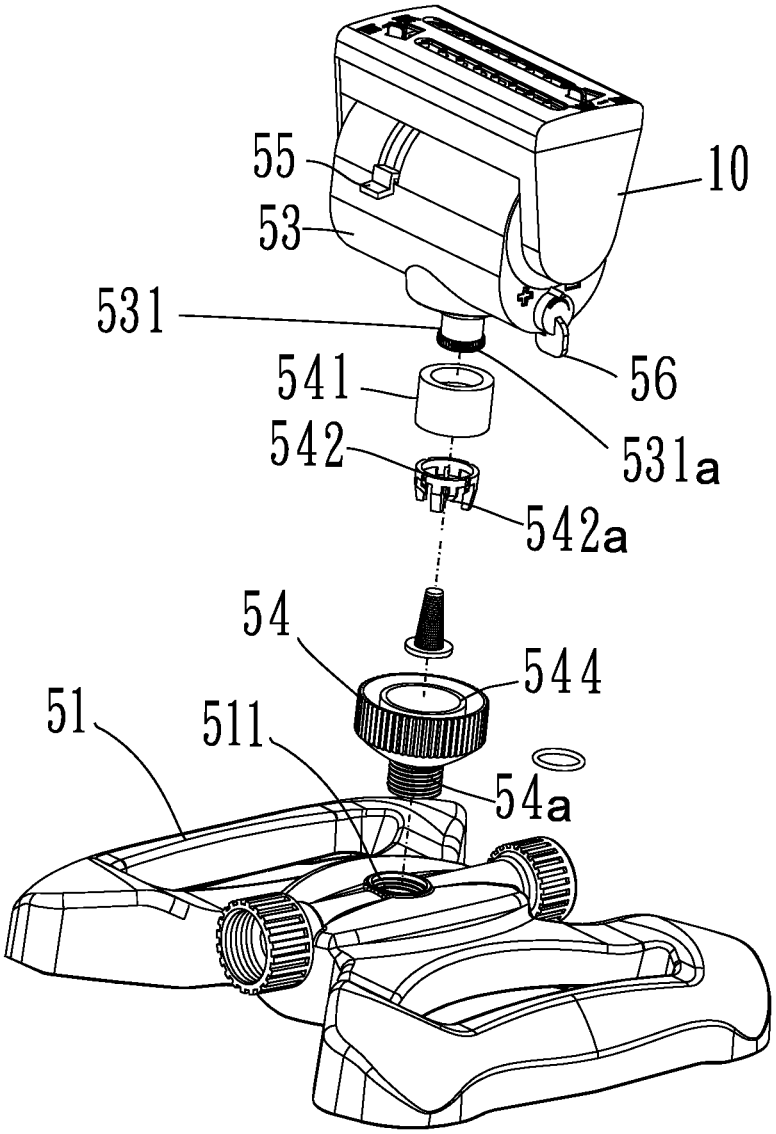
FIG. 6 is an explosive view of the FIG. 5.
Figure 7:
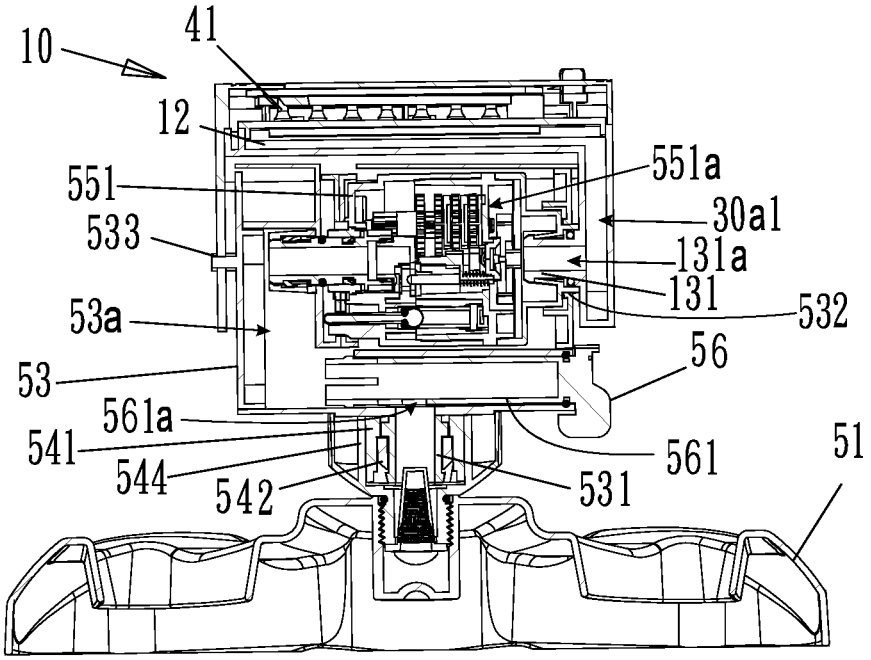
FIG. 7 is a cross sectional view according to an embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1 to FIG. 4 of the drawings, a sprinkler adjustment member for a according to a first embodiment is illustrated, wherein the nozzle adjustment member for a sprinkler comprises a sprinkler base 10, an adjustment piece 20, a cover 30 and two nozzle sets 40.

The sprinkler base 10 comprises a flat top stage 11 and a base 13 having a receiving slot 12 with an opening formed upwardly. A plurality of holes 14 spaced at an interval is disposed on a top wall of the sprinkler base 10. The holes 14 are arranged in at least one row. A pivot support 15 with the same height are arranged at one end of the row of holes 14. The holes 14 are positioned over and assembled with a plurality of nozzle tubes 41 of the two nozzle sets 40. The holes 14 disposed on the pivot support 15 are assembled with corresponding the nozzle tubes 41 of the nozzle sets 40 while the pivot support 15 is received in a pivot hole 21 of the adjustment piece 20.

Each of the two nozzle sets 40 comprises a plurality of nozzle tubes 41 and a belt 42 connecting to the bottom of the plurality of nozzle tubes 41. And the plurality of nozzle tubes 41 of each nozzle set 40 is assembled with the holes 14 on the sprinkler base 10. Moreover, the belt 42 of each nozzle set 40 can be integrated into one piece.

The adjustment piece 20 includes a plurality of guiding openings 22 arranged in one row and a pivot hole 21 disposed on one end thereof. The pivot hole 21 is for being pivoted in or covered around the pivot support 15 of the sprinkler base 10. Moreover, at least one pin 24 is set on the bottom of the other end of the bottom of the adjustment piece 20. The pivot hole 21 and the pin 24 are at the same height and their bottoms are leaning against the flat top stage 11 of the sprinkler base 10. Furthermore, a control part 23 extending integrally is arranged on the other end of the adjustment piece 20 and is opposite to the pivot hole 21.

As shown in FIG. 1, the adjustment piece 20 has a tapered shape that a width of the adjusting piece 20 is gradually reducing toward the pivot hole 21. The guiding openings 22 are inclinedly formed on the adjustment piece 20, wherein the lengths of the guiding openings 22 are reduced toward the pivot hole 21. In other words, the guiding opening 22 at a position far away the pivot hole 21 is an elongated slot having a length longer than the length of the adjacent guiding opening 22. As reducing the lengths of the guiding openings 22, the guiding opening 22 close to the pivot hole 21 is also an elongated slot with the shortest length.

The cover 30 has a downward opening for connecting with and covering the sprinkler base 10. A plurality of long through holes 31 corresponding to the plurality of nozzle tubes 41 is disposed on top of the cover 30 and is arranged into one row. Each of the long through holes 31 is positioned over one of the plurality of nozzle tubes 41 correspondingly. At least one shaft tube 32 is arranged at one end of each row of the plurality of through holes 31 so as to insert into the pivot support 15 of the sprinkler base 10 or the pivot hole 21 of the adjustment piece 20. Moreover, a window 33 is disposed on one end of the row of the long through holes 31. The window 33 is not only for receiving the control part 23, but also providing a certain space for displacement of the control part 23. It is worth mentioning that the shaft tube 32 is mounted inside the pivot support 15 and has a preset shaft hole 321 which is positioned over the corresponding nozzle tube 41 according to the embodiment of the present invention.

Thereby, the sprinkler adjustment member according to the present invention thereby the adjustment piece 20 driving the nozzle tubes 41 for adjusting 2 dimensional water jets. Two adjustment pieces 20 swing respectively around the pivot hole 21 which is used as a static pivot so as to move the plurality of nozzle tubes 41 at different angle synchronously.

As shown in the FIG. 2, FIG. 5 to FIG. 8, the sprinkler adjustment member for adjusting 3 dimensional water jets of the present invention is illustrated. The sprinkler adjustment member according to the embodiment of the present invention includes a place base 51, at least one inlet 52 arranged at one side of the place base 51 for being connected with a water pipe or a water source, and a receiving member 53 assembled with the place base 51. A screw connecting part 511 is disposed on one end of the place base 51. The sprinkler base 10 is disposed on the receiving member 53. Moreover, a first connecting member **30*a* and a second connecting member 30*b* are disposed on two sides of the sprinkler base 10 respectively and correspondingly. The first connecting member 30*a* has a guiding chamber 30*a*1 interconnecting with the receiving slot 12 of the sprinkler base 10. A first pivoting member 131 extending formed on an inner face of the guiding chamber 30*a*1 which is opposite to the second connecting member 30*b*. The second connecting member 30*b* has a trepanning 30*b*1 having a first channel 131*a***.

The receiving member 53 has a receiving chamber **53*a* and a secondary chamber 551 is pivotally disposed on the receiving chamber 53*a*. The external diameter of the secondary chamber 551 matches with the internal diameter of the receiving chamber 53***a*. The secondary chamber 551 can rotate pivotally inside the receiving chamber 53*a* and a gear drive component 533 is disposed on thereof. A pivot connecting element 532 is disposed on one side of the receiving member 53 and a pivot 533 is disposed on the opposite side of the receiving member 53. Moreover, the first connecting member 30*a* and the second connecting member 30*b* of the sprinkler base 10 are positioned over the pivot connecting element 532 and the pivot 533 of the receiving member 53 respectively and correspondingly. The first pivoting member 131 is assembled with the pivot connecting element 532 of one side of the receiving member 53 for pivot joint connecting. The pivot 533 is assembled with the trepanning 30*b*1 of the second connecting member 30*b* for pivot joint connecting. The first channel 131*a* of the first pivoting member 131 is interconnect with the secondary chamber 551. The first connecting member 30*a* of the guiding chamber 30*a*1 guides the water into the receiving slot 12 and the plurality of nozzle tubes 41 generate water distribution patterns.

A set of control buttons 55 for adjustment angle of the pendulum movement of the sprinkler base 10 extending upwardly is formed by the secondary chamber 551 of the receiving member 53, thereby driving the control buttons 55 so as to rotate the secondary chamber 551 and the sprinkler base 10 synchronously.

A second pivoting member 531 extends from one end of the receiving member 53 for 360 degrees of rotation of the sprinkler base 10 and the receiving member 53. A tooth member 531*a* is disposed on the bottom of the second pivoting member 531.

Figure 8:
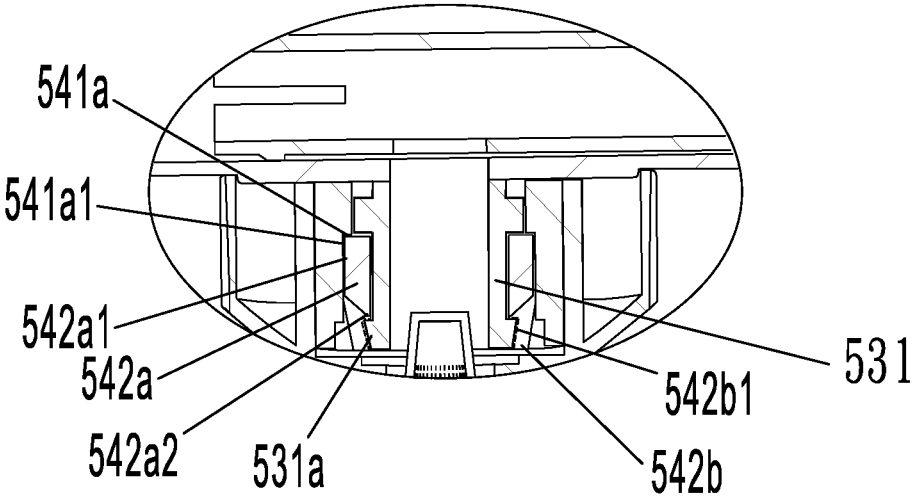
FIG. 8 is a partial enlarged cross sectional view of FIG. 7.

The receiving member 53 is pivoted with the place base 51, assisted with a assemble member 54 matching a pipe element 541 and a sleeve element 542. The assemble member 54 comprises a spiral tooth member 54*a* having a slot part 544 on one end thereof. As shown in FIG. 8, the pipe element 541 has a step part 541*a* on the inner diameter and a plurality of gutters 541*a*1 extends from the extensive inner diameter of the step part 541*a*. The sleeve element 542 formed into an annular body by a plurality of short claws 542*a* assembled with a plurality of long claws 542*b* in order. The bottom of the external diameter of the short claw 542*a* extends to form a convex part 542*a*1 and the bottom of the inner diameter of the long claw 542*b* extends to form a concave part 542*b*1. The sleeve element 542 is positioned over and located in the pipe element 541. The pipe element 541 is fixed with the slot part 544 firmly and push downwardly the second pivoting member 531 inserted through the sleeve element 542. The tooth member 531*a* of the second pivoting member 531 abuts against a tail end 542*a*2 of the convex part 542*a*1. The bottom of the inner diameter of the long claw 542*b* is strutted by the pipe element 541. The tooth member 531*a* of the second pivoting member 531 is stuck in the concave part 542*b*1 temporarily. The long claw 542*b* is able to be opened and is elastic to reset. Thus although the tooth member 531*a* of the second pivoting member 531 is stuck in the concave part 542*b*1 temporarily, when the receiving member 53 is rotated, the tooth member 531*a* is driven to deviate from the concave part 542*b*1 and is temporarily located in the next concave part 542*b*1, thereby the receiving member 53 on the place base 51 is able move a 360 degrees rotation because of the design of the second pivoting member 531. The first pivoting member 131 on the receiving member 53 is capable of making umbrella-type path movement upwardly and downwardly for adjustment angle location. Thereby providing the object of moving and tilting at multi-angles and multi-directions for providing various sprinkling patterns are achieved by the sprinkler base 10.

A fine adjustment knob 56 and a control button 55 as a control component for the adjustment of the sprinkler are disposed on the receiving member 53. The fine adjustment knob 56 comprises an axle tube 561 extending outwardly from the inner space of the receiving member 53 and having a through hole 561*a*. The through hole 561*a* is interconnected to a water channel exit of the second pivoting member 531. When rotating the fine adjustment knob 56, the axle tube 561 is deviated from the water channel exit of the second pivoting member 531 as the skewing of the through hole 561*a*, thereby adjusting water output from the water channel exit of the second pivoting member 531 to the receiving chamber 53*a* or closing the water output.

Figure 9:
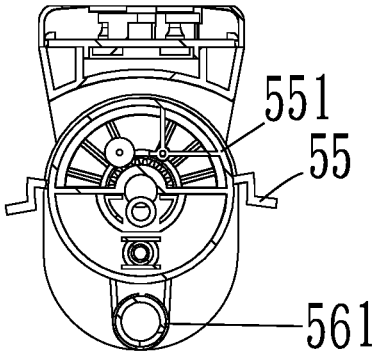
FIG. 9 is another cross sectional view according to an embodiment of the present invention.

As shown in FIG. 9, the control button 55 is disposed on two sides of the receiving member 53 and is connected with the secondary chamber 551. Thus while the control button 55 is operated, the receiving member 53 is driven to rotate synchronously. And then the receiving member 53 pivoted with the sprinkler base 10 is driven to rotate synchronously. The rotating path of the sprinkler base 10 is a pendulum path for angles adjustment.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A sprinkler adjustment member, comprising:

a sprinkler base in which a plurality of nozzle tubes is disposed and comprising a first connecting member and a second connecting member, wherein said first connecting member and said second connecting member are respectively disposed on two sides of said sprinkler base, a receiving member, comprising a pivoting arrangement, pivoted with said first connecting member and said second connecting member on two sides respectively and correspondingly, wherein said pivoting arrangement is disposed on one end of said receiving member, such that said sprinkler base is pivotable on said receiving member for adjustment angle with a pendulum movement, a place base, wherein said pivoting arrangement of said receiving member is positioned over said place base and said receiving member is capable of rotating pivotally for 360 degrees on said place base to provide a desired tilting angle of said sprinkler base, such that said sprinkler base moves and tilts at multi-angles and multi-directions for providing various sprinkling patterns; and a nozzle cover having a plurality of through holes, and an adjustment piece, wherein said sprinkler base having at least a plurality of holes aligned in a row and disposed on top thereof, wherein said nozzle cover coupled at said sprinkler base at a position that said through holes are positioned over said nozzle tubes, wherein said adjustment piece has a pivot end pivotally engaged with said sprinkler base and a plurality of guiding openings spacedly formed at an interval to receive said nozzle tubes, such that when said adjustment piece is pivotally swung, said nozzle tubes are driven to move and tilt at different angle for providing various sprinkling patterns, wherein said adjustment piece has a tapered shape that a width of said adjustment is gradually reduced toward said pivot end.

2. A sprinkler adjustment member, comprising:

a sprinkler base in which a plurality of nozzle tubes is disposed and comprising a first connecting member and a second connecting member, wherein said first connecting member and said second connecting member are respectively disposed on two sides of said sprinkler base, a receiving member, comprising a pivoting arrangement, pivoted with said first connecting member and said second connecting member on two sides respectively and correspondingly, wherein said pivoting arrangement is disposed on one end of said receiving member, such that said sprinkler base is pivotable on said receiving member for adjustment angle with a pendulum movement, a place base, wherein said pivoting arrangement of said receiving member is positioned over said place base and said receiving member is capable of rotating pivotally for 360 degrees on said place base to provide a desired tilting angle of said sprinkler base, such that said sprinkler base moves and tilts at multi-angles and multi-directions for providing various sprinkling patterns; and a nozzle cover having a plurality of through holes, and an adjustment piece, wherein said sprinkler base having at least a plurality of holes aligned in a row and disposed on top thereof, wherein said nozzle cover coupled at said sprinkler base at a position that said through holes are positioned over said nozzle tubes, wherein said adjustment piece has a pivot end pivotally engaged with said sprinkler base and a plurality of guiding openings spacedly formed at an interval to receive said nozzle tubes, such that when said adjustment piece is pivotally swung, said nozzle tubes are driven to move and tilt at different angle for providing various sprinkling patterns, wherein said guiding openings has different lengths that the lengths of said guiding openings are reduced toward said pivot end of said adjustment piece.

3. A sprinkler adjustment member, comprising:

a sprinkler base comprising a first connecting member and a second connecting member located at two sides of said sprinkler base, wherein said sprinkler base further comprises a plurality of nozzle tubes;

a receiving member which comprises a pivoting member, wherein said receiving member is pivotally coupled with said first connecting member an said second connecting member, such that said sprinkler base is pivotable on said receiving member for adjustment angle with a pendulum movement;

a place base, wherein said receiving member is pivoted with said place base; and an assemble member coupled between said place base and said receiving member, wherein said assemble member comprises a pipe element and a sleeve element formed into an annular body to have a plurality of short claws and a plurality of long claws, wherein said sleeve element is located in said pipe element that said long claws are strutted by said pipe element, wherein said pivoting member of said receiving member is inserted through said sleeve element to engage with said short claws, such that said receiving member is selectively and pivotally rotating for 360 degrees on said place base to provide a desired tilting angle of said sprinkler base, while said sprinkler base moves and tilts at multi-angles and multi-directions for providing various sprinkling patterns.

4. The sprinkler adjustment member, as recited in claim 3, wherein a bottom of an external diameter of each of said short claws forms a convex part and a bottom of an inner diameter of each of said long claws forms a concave part, wherein said pivoting member has a tooth member formed at an end thereof, wherein said tooth member of said pivoting member abuts against a tail end of said convex part and is stuck in said concave part temporarily, wherein each of said long claws is elastic, wherein when said receiving member is rotated, said tooth member is driven to deviate from one of said concave parts and is temporarily located in the next concave part.

5. The sprinkler adjustment member, as recited in claim 4, wherein said place base has a screw connecting part, wherein said assemble member further comprises a spiral tooth member coupled at said screw connecting part of said place base.

6. The sprinkler adjustment member, as recited in claim 5, wherein said spiral tooth member has a slot part at one end thereof, wherein said pipe element is fixed with said slot part firmly.

7. The sprinkler adjustment member, as recited in claim 3, further comprising a nozzle cover having a plurality of through holes, and an adjustment piece, wherein said sprinkler base having at least a plurality of holes aligned in a row and disposed on top thereof, wherein said nozzle cover coupled at said sprinkler base at a position that said through holes are positioned over said nozzle tubes, wherein said adjustment piece has a pivot end pivotally engaged with said sprinkler base and a plurality of guiding openings spacedly formed at an interval to receive said nozzle tubes, such that when said adjustment piece is pivotally swung, said nozzle tubes are driven to move and tilt at different angle for providing various sprinkling patterns.

8. The sprinkler adjustment member, as recited in claim 4, further comprising a nozzle cover having a plurality of through holes, and an adjustment piece, wherein said sprinkler base having at least a plurality of holes aligned in a row and disposed on top thereof, wherein said nozzle cover coupled at said sprinkler base at a position that said through holes are positioned over said nozzle tubes, wherein said adjustment piece has a pivot end pivotally engaged with said sprinkler base and a plurality of guiding openings spacedly formed at an interval to receive said nozzle tubes, such that when said adjustment piece is pivotally swung, said nozzle tubes are driven to move and tilt at different angle for providing various sprinkling patterns.

9. The sprinkler adjustment member, as recited in claim 7, wherein said adjustment piece has a tapered shape that a width of said adjustment is gradually reduced toward said pivot end.

10. The sprinkler adjustment member, as recited in claim 8, wherein said adjustment piece has a tapered shape that a width of said adjustment is gradually reduced toward said pivot end.

11. The sprinkler adjustment member, as recited in claim 7, wherein said guiding openings has different lengths that the lengths of said guiding openings are reduced toward said pivot end of said adjustment piece.

12. The sprinkler adjustment member, as recited in claim 8, wherein said guiding openings has different lengths that the lengths of said guiding openings are reduced toward said pivot end of said adjustment piece.

* * * * *